US008541952B2

(12) United States Patent
Darshan

(10) Patent No.: US 8,541,952 B2
(45) Date of Patent: Sep. 24, 2013

(54) USER CONTROL OF AN LED LUMINAIRE FOR A PHASE CUT DIMMER

(75) Inventor: Yair Darshan, Petach Tikva (IL)

(73) Assignee: Microsemi Corp.—Analog Mixed Signal Group Ltd., Hod Hasharon (IL)

( * ) Notice: Subject to any disclaimer, the term of this patent is extended or adjusted under 35 U.S.C. 154(b) by 153 days.

(21) Appl. No.: 13/353,340

(22) Filed: Jan. 19, 2012

(65) Prior Publication Data

US 2012/0194091 A1 Aug. 2, 2012

Related U.S. Application Data

(60) Provisional application No. 61/437,740, filed on Jan. 31, 2011.

(51) Int. Cl.
*H05B 37/02* (2006.01)

(52) U.S. Cl.
USPC ..... 315/209 R; 315/220; 315/194

(58) Field of Classification Search
USPC ..... 315/209 R, 210, 212, 213, 219, 220, 315/225, 194, 195, 246, 276, 277, 287, 291
See application file for complete search history.

(56) References Cited

U.S. PATENT DOCUMENTS

| | | | | |
|---|---|---|---|---|
| 5,430,356 | A * | 7/1995 | Ference et al. | 315/291 |
| 6,975,078 | B2 * | 12/2005 | Yanai et al. | 315/291 |
| 7,902,769 | B2 * | 3/2011 | Shteynberg et al. | 315/291 |
| 8,222,832 | B2 * | 7/2012 | Zheng et al. | 315/291 |

* cited by examiner

*Primary Examiner* — James H Cho
(74) *Attorney, Agent, or Firm* — Simon Kahn

(57) ABSTRACT

A phase cut angle converter with range detection for a phase cut dimmer constituted of: a phase cut angle detector arranged to detect the phase cut angle presented by the phase cut dimmer blocking a portion of an alternating current mains power sine wave from reaching a power converter, and output a signal whose value is responsive to the detected phase cut angle; a storage functionality constituted of a memory in communication with the phase cut angle detector, the storage functionality arranged to detect each of a minimum value and a maximum value for the detected phase cut angle of the phase cut angle detector and store the minimum value and the maximum value on the memory; and a signal adjustment functionality arranged to convert the detected phase cut angle to a dimming signal responsive to the stored minimum value and the maximum value for the detected phase cut angle.

14 Claims, 3 Drawing Sheets

USER CONTROL OF AN LED LUMINAIRE FOR A PHASE CUT DIMMER

CROSS-REFERENCE TO RELATED APPLICATIONS

This application claims priority to U.S. Provisional Patent Application Ser. No. 61/437,740 filed Jan. 31, 2011, entitled "Improved User Control of an LED Luminaire for a Phase Cut Dimmer", the entire contents of which is incorporated herein by reference.

BACKGROUND OF THE INVENTION

The present invention relates to the circuits for use with a phase cut dimmer, and in particular to an arrangement where the range of a phase cut dimmer is learned over time and utilized to improve user control of an LED luminaire.

Solid state lighting, and in particular light emitting diodes (LEDs) are rapidly coming into wide use for lighting applications. In most general lighting applications the LEDs are supplied in one or more strings of serially connected LEDs sharing a common current.

LEDs providing high luminance exhibit a range of forward voltage drops, denoted $V_f$, and their luminance is primarily a function of current. Brightness control of the LEDs may be performed by either pulse width modulation (PWM) or by amplitude modulation. In a PWM brightness control a fixed current is driven through the LED string, and the duty cycle of the fixed current is adjusted in order to control the LED string brightness. In amplitude modulation the amount of current through the LED string is varied directly, thus adjusting the brightness. LED strings exhibit a particular voltage to current relationship, wherein for a voltage below a minimum operating voltage no appreciable current flows, and for voltages exceeding the minimum operating voltage the current follows an exponential curve responsive to the voltage.

A phase cut dimmer is a device arranged to provide control of the brightness of a lighting source by blocking a portion of the alternating current (AC) mains power sine wave from reaching the lighting source. Both leading edge dimmers, wherein the leading edge of the sine wave is blocked by a settable conduction angle, and trailing edge dimmers wherein a trailing edge of the sine wave is blocked are commercially available. Other phase cut dimmers which allow selection of the portion of the sine wave to pass are also known. Phase cut dimmers are typically implemented by thyristors which require a minimum holding current, denoted $I_h$ to operate smoothly, and exhibit a phase delay angle, denoted herein as phase cut angle $\phi$.

Phase cut dimmers exhibit a range of phase cut angles $\phi$, which may vary between models, and even between phase cut dimmers of the same model type, particularly in the event that the minimum holding current is supplied by the LED luminaire driver. In particular, a phase cut dimmer is typically unable to pass 100% of the AC mains power sine wave, and typically does not exceed a maximum of 90% of the AC mains power sine wave. Similarly, phase cut dimmers are typically unable to pass less than 10% of the AC mains power sine wave, since the phase cut dimmer is connected serially with the AC mains voltage and thus block a certain percentage of AC mains power sine wave.

LED lighting typically requires a constant current power source, and is thus preferably isolated from the direct action of the phase cut dimmer. What is desired is a means of utilizing a phase cut dimmer to control the brightness of an LED based luminaire in a manner wherein the LED based luminaire brightness is controlled over the entire range of achievable brightness responsive to the actually installed phase cut dimmer.

SUMMARY OF THE INVENTION

Accordingly, it is a principal object of the present invention to overcome at least some of the disadvantages of prior art LED based luminaire drivers. This is provided in certain embodiments by a controller arranged to detect the range of operating angles of the actually installed phase cut dimmer, and control the brightness of an LED based luminaire responsive to the learned range.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
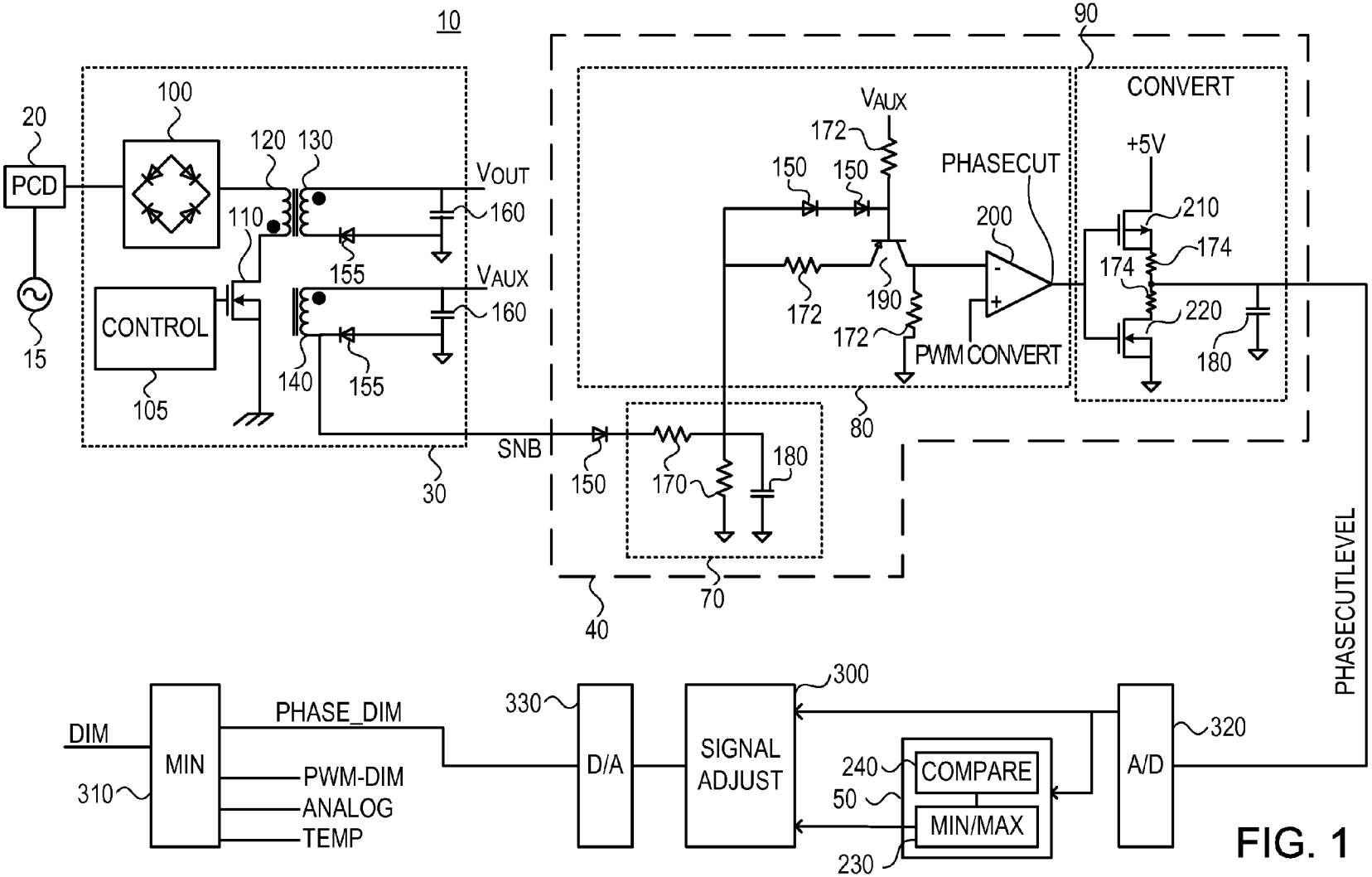
FIG. 1 illustrates a high level schematic diagram of an exemplary embodiment of a phase cut angle converter implemented in cooperation with a flyback converter.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level schematic diagram of an exemplary embodiment of a phase cut angle converter 10 wherein a power converter is implemented as a flyback converter. In particular the embodiment of FIG. 1 comprises: an AC mains power source 15; a phase cut dimmer 20; a power converter 30; a phase cut angle detector 40; a storage functionality 50, comprising a memory 230 and a comparing functionality 240; a signal adjustment functionality 300; a minimum function circuit 310; an analog to digital converter (ADC) 320; and a digital to analog converter (DAC) 330. Power converter 30 comprises: a full wave rectifier 100, a control circuit 105; an electronically controlled switch 110, illustrated without limitation as an NMOSFET; a primary winding 120; a first secondary winding 130; a second secondary winding 140; a plurality of unidirectional electronic valves 155, illustrated without limitation as diodes; and a plurality of output capacitors 160. Primary winding 120 is magnetically coupled to each of first secondary winding 130 and second secondary winding 140 to form a transformer.

Phase cut angle detector 40 comprises a first unidirectional electronic valve 150, illustrated without limitation as a diode; a low pass filter 70; a phase cut detector 80; and a conversion circuit 90. Low pass filter 70 comprises a first and second resistor 170 and filtering capacitor 180. Phase cut detector 80 of phase cut angle detector 40 comprises a second and a third unidirectional electronic valve 150, illustrated without limitation as diodes 150; a first, second and a third resistor 172; a PNP transistor 190; a differential amplifier 200 arranged to function as a comparator; and a conversion reference voltage denoted PWMCONVERT. Conversion circuit 90 comprises: a first electronically controlled switch 210 implemented without limitation as a PMOSFET; a second electronically controlled switch 220 implemented without limitation as an NMOSFET; a first and a second resistor 174; and a filtering capacitor 180. Memory 230 has stored thereon a minimum value and a maximum value, as will be described further hereinto below.

AC mains power source 15 is connected via phase cut dimmer 20 to the input of full wave rectifier 100, and the output of full wave rectifier 100 is connected to a first end of primary winding 120. A second end of primary winding 120, with its polarity indicated by a dot, is connected to the drain of electronically controlled switch 110 of power converter 30, and the source of electronically controlled switch 110 of power converter 30 is connected to a primary side common point. The gate of electronically controlled switch 110 of power converter 30 is connected to the output of control circuit 105, whose feedback loop is not shown for simplicity.

A first end of first secondary winding 130, with its polarity indicated by a dot, is connected to a first end of a respective output capacitor 160, and denoted VOUT. Preferably, VOUT is connected to the first end of a load (not shown). A second end of first secondary winding 130 is connected to the cathode of a respective unidirectional electronic valve 155 of power converter 30, and the anode of the respective unidirectional electronic valve 155 is connected to a second end of the respective output capacitor 160, and to a secondary side common point.

A first end of second secondary winding 140, with its polarity indicated by a dot, is connected to a first end of a respective output capacitor 160, and denoted VAUX. Preferably, VAUX is connected to a load (not shown), such as the power connection of control circuit 105. A second end of second secondary winding 140 is connected to the cathode of a respective unidirectional electronic valve 155 of power converter 30 and to the anode of first unidirectional electronic valve 150 of phase cut angle detector 40, and is denoted SNB. The anode of the respective unidirectional electronic valve 155 of power converter 30 is connected to a second end of the respective output capacitor 160, and to the secondary side common point.

The cathode of first unidirectional electronic valve 150 of phase cut angle detector 40 is connected to a first end of first resistor 170 of low pass filter 70. A second end of first resistor 170 of low pass filter 70 is connected via second resistor 170 of low pass filter 70 to the secondary side common point, and in parallel via filtering capacitor 180 of low pass filter 70 to the secondary side common point. The second end of first resistor 170 of low pass filter 70 is further connected to a first end of first resistor 172 of phase cut detector 80 and to the anode of second unidirectional electronic valve 150 of phase cut detector 80. Optionally, a protection unidirectional electronic valve (not shown) is further provided between the second end of first resistor 170 of low pass filter 70 and the anode of second unidirectional electronic valve 150 of phase cut detector 80. The cathode of second unidirectional electronic valve 150 of phase cut detector 80 is connected to the anode of third unidirectional electronic valve 150 of phase cut detector 80 and the cathode of third unidirectional electronic valve 150 of phase cut detector 80 is connected to the base of PNP transistor 190 and via second resistor 172 of phase cut detector 80 to VAUX. A second end of first resistor 172 of phase cut detector 80 is connected to the emitter of PNP transistor 190 and the collector of PNP transistor 190 is connected to the secondary side common point via third resistor 172 of phase cut detector 80 and to the inverting input of comparator 200 of phase cut detector 80.

The non-inverting input of comparator 200 of phase cut detector 80 is connected to conversion reference voltage PWMCONVERT and the output of comparator 200 of phase cut detector 80 is connected to the gate of each of first electronically controlled switch 210 and second electronically controlled switch 220 of conversion circuit 90. The drain of first electronically controlled switch 210 of conversion circuit 90 is connected to a maximum range voltage, illustrated without limitation as +5V, and the source of first electronically controlled switch 210 of conversion circuit 90 is connected to the drain of second electronically controlled switch 220 of conversion circuit 90 via first and second resistors 174 of conversion circuit 90 in series. The source of second electronically controlled switch 220 of conversion circuit 90 is connected to the secondary side common point. The common node of first and second resistors 174 of conversion circuit 90 is connected via filtering capacitor 180 of conversion circuit 90 to the secondary side common point, is denoted PHASECUTLEVEL and is further connected to the input of ADC 320.

The output of ADC 320 is connected to comparing functionality 240 and to a first input of signal adjustment functionality 300. A second input of signal adjustment functionality is connected to memory 230. The output of signal adjustment functionality 300 is connected to the input of DAC 330 and the output of DAC 330 is connected to a first input of minimum function circuit 310. Other inputs of minimum function circuit 310 are connected variously to a PWM dimming input signal, denoted PWM-DIM, an analog dimming signal denoted ANALOG and a temperature input signal denoted TEMP.

Figure 2A:
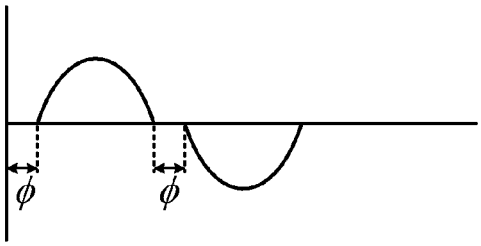
FIG. 2A illustrates an AC mains power sine wave wherein a phase cut dimmer has blocked a portion of a leading edge of the sine wave.
Figure 2B:
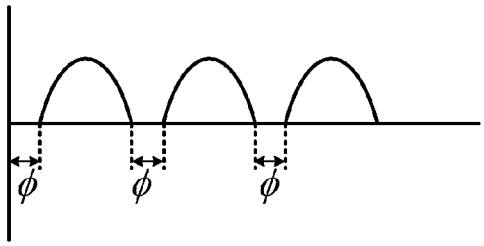
FIG. 2B illustrates a full wave rectified DC signal developed from an AC mains power sine wave in the presence of a phase cut dimmer.
Figure 2C:
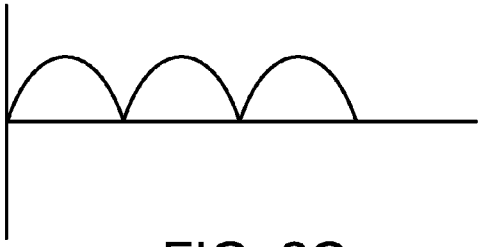
FIG. 2C illustrates a full wave rectified DC signal developed from an AC mains power sine wave in the absence of a phase cut dimmer.
Figure 2D:
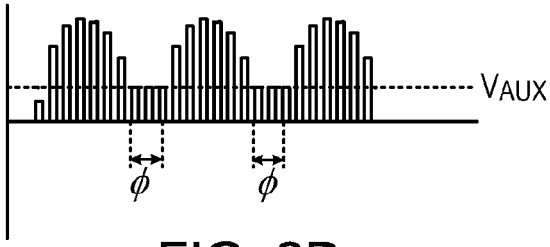
FIG. 2D illustrates the signal at a point labeled SNB of FIG. 1, which comprises a reflection of a received AC power signal superimposed onto a direct current signal.

FIG. 2A illustrates an AC mains power sine wave wherein phase cut dimmer 20 has blocked a portion of a leading edge of the sine wave, wherein the x-axis represents time and the y-axis represents amplitude, and the phase cut angle is denoted ϕ. FIG. 2B illustrates a full wave rectified DC signal output from full wave rectifier 100 of FIG. 1 developed from the AC mains power sine wave of FIG. 2A, wherein the x-axis represents time and the y-axis represents amplitude. FIG. 2C illustrates a full wave rectified DC signal output from full wave rectifier 100 of FIG. 1 developed from an AC mains power sine wave in the absence of phase cut dimmer 20, wherein the x-axis represents time and the y-axis represents amplitude. FIG. 2D illustrates signal SNB of FIG. 1, which comprises a reflection of the received alternating current power signal, including phase cut angle ϕ, superimposed onto a direct current signal VAUX, wherein the x-axis represents time and the y-axis represents amplitude.

The operation of FIG. 1 will now be described, with FIGS. 2A-2D being utilized to elaborate on certain signals. An AC mains power signal is output by AC mains power source 15 and is received at full wave rectifier 100, via phase cut dimmer 20. A portion of the sine wave from AC mains power source 15 is blocked, illustrated as phase cut angle ϕ of FIG. 2A. The received AC mains power signal is rectified by full wave rectifier 100, and presents a rectified sine wave reflecting phase cut angle ϕ, i.e. the blocked portion of the AC mains power signal, as illustrated in FIG. 2B. In the absence of any phase cut dimmer 20, the output of full wave rectifier 100 presents a complete rectified sine wave, as illustrated in FIG. 2C.

Control circuit 105 alternately opens and closes electronically controlled switch 110, at a significantly higher frequency than the frequency of the AC mains power signal, to convert the received power from full wave rectifier 100 to DC power VOUT and to DC power VAUX. In particular, when electronically controlled switch 110 is closed current passes through primary winding 120, and substantially no current passes through first secondary winding 130 due to the action of the respective unidirectional electronic valve 155 which is reverse biased. Similarly, substantially no current passes through second secondary winding 140 due to the action of the respective unidirectional electronic valve 155 which is reverse biased. When electronically controlled switch 110 is opened substantially no current passes through primary winding 120, and power is transferred to first secondary winding 130, charging respective output capacitor 160, and power is further transferred to second secondary winding 140 charging respective output capacitor 160.

The voltage at SNB, is illustrated in FIG. 2D. In particular, when electronically controlled switch 110 is closed, the voltage at SNB is the voltage appearing across primary winding 120 times the ratio of the turns between primary winding 120 and second secondary winding 140, plus VAUX. When electronically controlled switch 110 is opened, the voltage at SNB falls to near the secondary side common point. Thus, the high frequency switching of electronically controlled switch 110 develops an envelope reflecting the value of the instantaneous voltage presented to primary winding 120 by full wave rectifier 100 with the addition of VAUX. During the portion of the sine wave from AC mains power source 15 which is blocked by the action of phase cut dimmer 20, i.e. phase cut angle ϕ, the envelope reflects the value VAUX.

Low pass filter 70 filters the signal appearing at SNB and removes the high frequency signal caused by the action of electronically controlled switch 110, thus leaving only the envelope described above in relation to FIG. 2D. Phase cut detector 80 subtracts voltage VAUX from the envelope. In particular, when the value of the envelope exceeds VAUX by an emitter base drop of PNP transistor 190, PNP transistor 190 conducts creating a voltage drop across third resistor 172 of phase cut detector 80. Thus, a voltage drop across third resistor 172 of phase cut detector 80 is produced during the period when the sine wave from AC mains power source 10 is not blocked, and no voltage drop across third resistor 172 of phase cut detector 80 is produced during the period when the sine wave from AC mains power source 10 is blocked. Second and third diodes 150 of phase cut detector 80 ensure proper bias for PNP transistor 190 while preventing excessive voltage from appearing at the base-emitter junction of PNP transistor 190. Alternatively (not shown), a single diode whose anode is connected to the base of PNP transistor 190 may be substituted for second and third diodes 150, in the event that a proper protection circuit is further provided for the output of low pass filter 70. The output voltage developed across third resistor 172 of phase cut detector 80 is compared with conversion reference voltage PWMCONVERT by comparator 200 of phase cut detector 80 so as to develop a square wave signal, denoted PHASECUT. PHASECUT is thus a pulse width modulated signal whose duty cycle reflects the portion of the AC mains power source 15 sine wave which has not been blocked by phase cut dimmer 20.

Output PHASECUT of phase cut detector 80 is expanded to swing over the range from a maximum value, illustrated as +5V to a minimum value by the action of first and second electronically controlled switches 210, 220. It is to be understood that in practice a small voltage drop may occur across third resistor 172 of phase cut detector 80 during the period when the sine wave from AC mains power source 15 is blocked due to noise in the system or any discharge from second secondary winding 140, and thus the value for PWMCONVERT is selected so as to eliminate these small voltage drops not reflective of an actual received AC sine wave signal.

The output of first and second electronically controlled switches 210, 220 is filtered by the action of first and second resistor 174 and filtering capacitor 180 of conversion circuit 90, and fed to ADC 320 as signal PHASECUTLEVEL. Signal PHASECUTLEVEL thus represents a DC value reflective of the duty cycle of signal PHASECUT output by phase cut detector 80, i.e. a phase cut level, with the DC value ranging from 0 to the preselected maximum voltage.

The digital conversion of signal PHASECUTLEVEL is fed to signal adjustment functionality 300 and is further compared with the minimum and maximum values stored on memory 230 by comparing functionality 240, as will be described further below.

Signal adjustment functionality 300 adjusts the dimming level signal of signal PHASECUTLEVEL responsive to the minimum and maximum values. In particular, signal adjustment functionality 300 is arranged to receive a digitized sample of signal PHASECUTLEVEL and convert it to a value wherein low values are de-emphasized and higher values are emphasized. In one non-limiting embodiment the conversion of signal PHASECUTLEVEL is given by the equation:

$$VOUT=k*f(\text{PHASECUTLEVEL})+B \quad \text{(EQ. 1)}$$

wherein B is an offset constant. In one embodiment f(PHASECUTLEVEL) is a non-linear function of signal PHASECUTLEVEL and in one further embodiment f(PHASECUTLEVEL) is PHASECUTLEVEL^ 4. De-emphasizing lower values ensures that the brightness does not exceed the amount of power available from phase cut AC mains power signal at low levels, while further compensating for the non-linear reaction of the eye.

Since PHASECUTLEVEL is typically unable to reach the maximum and/or minimum voltage levels due to noise, phase cut dimmer limitations, converter 30 limitations, and/or other considerations, signal adjustment functionality 300 is operative to ensure that signal PHASECUTLEVEL is fully stretched from the absolute minimum allowed value to the absolute maximum allowed value, i.e. from a 0% brightness level to a 100% brightness level. Typically signal PHASECUTLEVEL is thus stretched by signal adjustment functionality 300 to range from a minimum value, responsive to constant B, up to +5V. Signal adjustment functionality 300 is further arranged to adjust constant k responsive to the minimum and maximum values stored on memory 230, thus adjusting EQ. 1 so as to convert signal PHASECUTLEVEL to the appropriate values, irrespective of the range of phase cut angles ϕ achievable by the actually installed phase cut dimmer 20. The minimum and maximum values stored on memory 230 represent the minimum and maximum values achievable by signal PHASECUTLEVEL.

Comparing functionality 240 is arranged to adjust the minimum and maximum values stored on memory 230 if signal PHASECUTLEVEL exceeds the boundary of one or both of the stored minimum and maximum values. In particular, in one non-limiting embodiment, comparing functionality 240 compares the digitally converted PHASECUTLEVEL signal with the minimum value stored on memory 230. In the event that PHASECUTLEVEL is less than the minimum value, the minimum value stored on memory 230 is updated to be equal to the current value of PHASECUTLEVEL. In the event that PHASECUTLEVEL is greater than the minimum value, PHASECUTLEVEL is further compared by comparing functionality 240 to the maximum value stored on memory 230. In the event that PHASECUTLEVEL is greater than the maximum value, the maximum value stored on memory 230 is updated to be equal to the current value of PHASECUTLEVEL. There is no requirement that the comparing be done in the above order and PHASECUTLEVEL can be compared first to the maximum value and then to the minimum value, or both comparisons may be performed simultaneously, without exceeding the scope. In one embodiment the initial minimum value stored on memory 230 is 25% of the allowable voltage range and the initial maximum value stored on memory 230 is 85% of the allowable voltage range.

The output of signal adjustment functionality 300 is converted to an analog value by DAC 330 and fed to a first input of minimum function circuit 310 as a dimming signal denoted PHASE_DIM. Other dimming inputs are similarly fed to other respective inputs of minimum function circuit 310, illustrated without limitation as PWM dimming value, an analog dimming value, and a temperature protection circuit, such as a thermistor, and optionally an ambient light sensor (not shown). Minimum function circuit 310 is arranged to pass the minimum value from among the various inputs to an output denoted DIM, which is preferably passed to control the amplitude of current passing through the load as a dimming signal. Advantageously, passing the temperature protection circuit to minimum function circuit 310 functions to perform excess temperature de-rating only when the excess temperature de-rating calls for an amplitude lower than that called for by the lowest value of the various dimming control inputs to minimum function circuit 310.

The above is illustrated in an embodiment wherein minimum function circuit 310 is implemented in an analog circuit as described below in relation to FIG. 3, however this is not meant to be limiting in any way. In another embodiment minimum function circuit 310 is implemented digitally, and DAC 330 is either not required, or is implemented after the minimum function. In yet another embodiment minimum function circuit 310 is not provided, and signal PHASE_DIM is utilized in place of dimming signal DIM.

Figure 3:
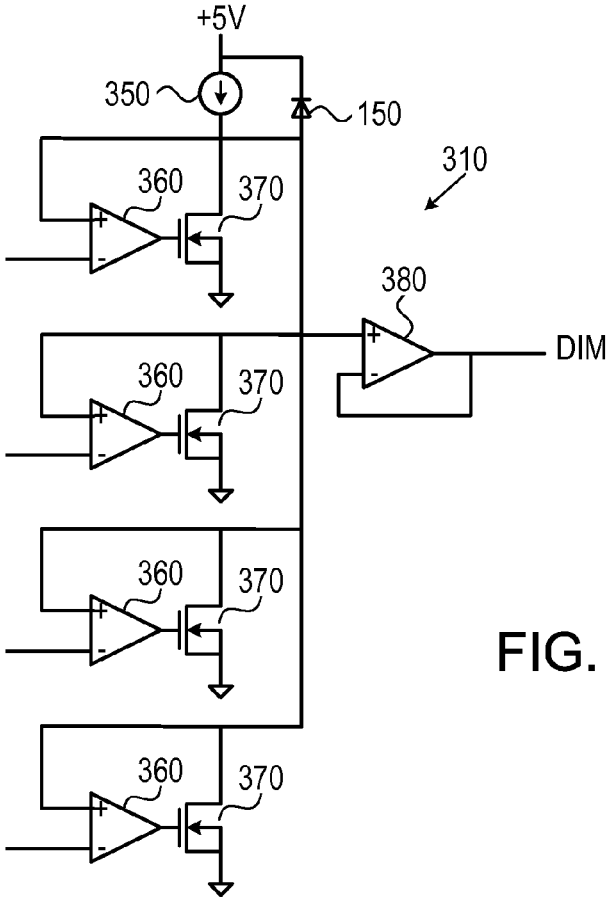
FIG. 3 illustrates a high level schematic diagram of an exemplary embodiment of a minimum function circuit of FIG. 1.

FIG. 3 illustrates a high level schematic diagram of an exemplary embodiment of minimum function circuit 310 of FIG. 2 comprising: a plurality of differential amplifiers 360; a plurality of electronically controlled switches 370, each implemented as an NMOSFET; a current source 350; a unidirectional electronic valve 150; and a buffer 380 implemented as a differential amplifier whose output is fed back to its inverting input. Each of the various inputs to minimum function circuit 310 are connected to the inverting input of a respective differential amplifier 360, and the output of each respective differential amplifier 360 is connected to the gate of a respective electronically controlled switch 370. The source of each electronically controlled switch is connected to the secondary side common point. The drain of each electronically controlled switch 370 is connected to the non-inverting input of the respective differential amplifier 360, to the input of buffer 380, to the output of current source 350 and to the anode of unidirectional valve 150. The cathode of unidirectional electronic valve 150 and the input of current source 350 are connected to a maximum value, illustrated without limitation as +5V. A compensation capacitor (not shown) is preferably further supplied between the input of buffer 380 and the secondary side common point to stabilize the operation of minimum function circuit 310.

In operation, the high gain of each of the differential amplifiers 360 functions to control the respective electronically controlled switch 370 to drive down the value at the input of buffer 380 to meet the respective input value. The lowest input value will dominate, since the respective electronically controlled switch 370 will continue to conduct while the balance of the electronically controlled switches 370 are cut off until the input to buffer 380 reaches the lowest input value.

Figure 4:
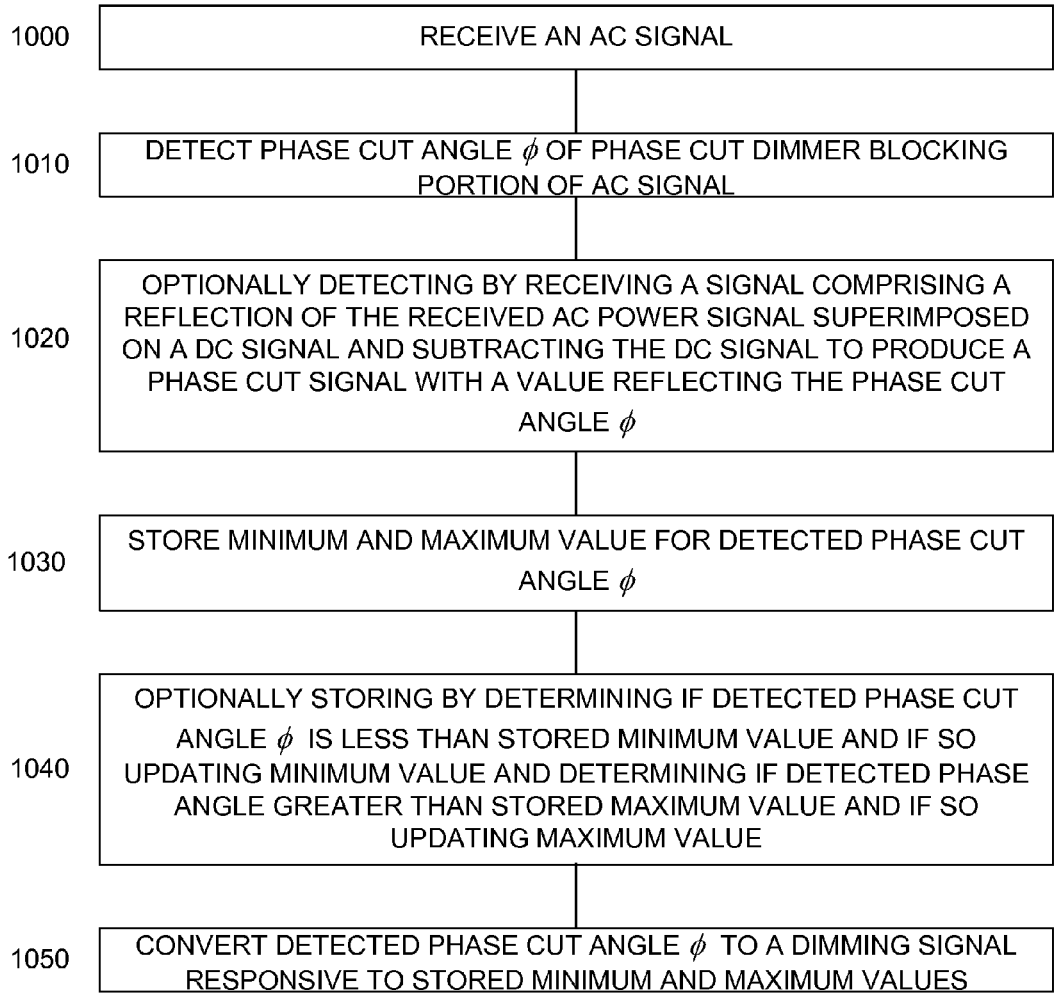
FIG. 4 illustrates a high level flow chart of an exemplary embodiment of a method of converting a phase cut angle to a dimming signal.

FIG. 4 illustrates a high level flow chart of an exemplary embodiment of a method of converting a phase cut angle to a dimming signal. In stage 1000 an AC power signal is received. In stage 1010 the phase cut angle ϕ of a phase cut dimmer blocking a portion of the received AC signal of stage 1000 is detected. Optionally, as described in stage 1020, detection of phase cut angle ϕ of the phase cut dimmer is accomplished by receiving a signal comprising a reflection of the received AC power signal of stage 1000 superimposed on a DC signal, as described above in relation to signal SNB, and subtracting the DC signal to produce a phase cut signal whose value, such as its duty cycle, reflects phase cut angle ϕ of stage 1000, as described above in relation to signal PHASECUT.

In stage 1030, a minimum and maximum value is stored for the detected phase cut angle ϕ of stage 1010. Optionally, as described in stage 1040, storing a minimum value comprises determining if the detected phase cut angle ϕ is less than the previously stored minimum value. In the event the detected phase cut angle ϕ is less than the previously stored minimum value, the stored minimum value is updated to be equal to the value of the detected phase cut angle ϕ. Storing a maximum value further comprises determining if the detected phase cut angle ϕ is greater than the previously stored maximum value. In the event the detected phase cut angle ϕ is greater than the previously stored maximum value, the stored maximum value is updated to be equal to the value of the detected phase cut angle ϕ. In stage 1050, the detected phase cut angle ϕ is converted to a dimming signal responsive to the stored minimum and maximum values of stage 1030. In one embodiment the detected phase cut angle ϕ, which is limited to a range of values, is converted so as to exhibit a larger range of values, as described above.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. A phase cut angle converter with range detection for a phase cut dimmer comprising:

a phase cut angle detector arranged to detect the phase cut angle presented by the phase cut dimmer blocking a portion of an alternating current mains power sine wave and output a phase cut level signal whose value is responsive to the detected phase cut angle;

a storage functionality comprising a memory, said storage functionality in communication with said phase cut angle detector and arranged to detect each of a minimum value and a maximum value for the phase cut level signal and store said minimum value and said maximum value on said memory; and a signal adjustment functionality arranged to convert the phase cut level signal to a dimming signal responsive to said stored minimum value and said maximum value for the detected phase cut angle.

2. The phase cut angle converter with range detection of claim 1, wherein said storage functionality further comprises a comparing functionality arranged to:

determine if the phase cut level signal is less than the stored minimum value and update said stored minimum value with the current value of the phase cut level signal in the event that the phase cut level signal is less than the stored minimum value; and determine if the phase cut level signal is greater than the stored maximum value and update said stored maximum value with the current value of the phase cut level signal in the event that the phase cut level signal is greater than the stored maximum value.

3. The phase cut angle converter with range detection according to claim 1, further comprising a power converter arranged to convert the received alternating current power signal to a direct current signal, wherein said power converter comprises a primary side and a secondary side isolated from the primary side, and wherein said phase cut angle detector is connected to the secondary side.

4. The phase cut angle converter with range detection according to claim 3, wherein said power converter comprises an auxiliary power winding isolated from the primary side, and wherein said phase cut angle detector is arranged to:

receive a signal comprising a reflection of the received alternating current power signal superimposed onto a direct current signal; and subtract the direct current signal from the received signal.

5. The phase cut angle converter with range detection according to claim 4, wherein said power converter is a flyback converter.

6. The phase cut angle converter with range detection according to claim 1, wherein said power converter comprises a flyback converter having a primary side switch connected in series with a primary side winding, said flyback converter further comprising a secondary side winding magnetically coupled with the primary side winding, and wherein said phase cut angle detector comprises:

a unidirectional electronic valve connected to the secondary side winding of the flyback converter, said unidirectional electronic valve arranged to output a reflection of the received alternating current signal superimposed on a direct current signal when said primary side switch is closed.

7. The phase cut angle converter with range detection according to claim 6, wherein said detector further comprises:

a phase cut detector arranged to subtract the direct current signal from the received reflection of the alternating current signal superimposed on the direct current signal and output a phase cut signal exhibiting a duty cycle, wherein the duty cycle is a function of the alternating current signal, and wherein the direct current signal is output by the secondary side winding.

8. The phase cut angle converter with range detection according to claim 7, further comprising a low pass filter connected between said unidirectional electronic valve and said phase cut detector.

9. The phase cut angle converter with range detection according to claim 7, further comprising a conversion circuit arranged to convert the output of said phase cut detector to the phase cut angle signal.

10. A method of converting a phase cut angle to a dimming signal, the method comprising:

receiving an alternating current power signal;

detecting the phase cut angle presented by a phase cut dimmer blocking a portion of the received alternating current power signal;

storing each of a minimum value and a maximum value for the detected phase cut angle of said phase cut angle detector; and converting the detected phase cut angle to a dimming signal responsive to the stored minimum value and the maximum value for the detected phase cut angle.

11. The method according to claim 10, wherein said storing each of the minimum value and the maximum value comprises:

determining if the detected phase cut angle is less than the stored minimum value and updating the stored minimum value with the detected phase cut angle in the event that the detected phase cut angle is less than the stored minimum value; and determining if the detected phase cut angle is greater than the stored maximum value and updating the stored maximum value with the detected phase cut angle in the event that the detected phase cut angle is greater than the stored maximum value.

12. The method according to claim 10, wherein said detecting the phase cut angle comprises:

receiving a signal comprising a reflection of the received alternating current power signal superimposed onto a direct current signal; and subtracting the direct current signal from the received signal to produce a phase cut signal which exhibits a duty cycle reflective of the unblocked portion of the alternating current power sine wave.

13. The method according to claim 12, wherein said detecting the phase cut angle further comprises:

prior to said subtracting, low pass filtering said received signal comprising a reflection of the received alternating current power signal superimposed onto a direct current signal.

14. The method according to claim 12, further comprising:

converting the produced phase cut signal to a phase cut level signal.

* * * * *